United States Patent [19]

Whalen

[11] 4,218,002

[45] Aug. 19, 1980

[54] STRIP MATERIAL CENTER GUIDE ASSEMBLY

[75] Inventor: John M. Whalen, Ansonia, Conn.

[73] Assignee: Olin Corporation, New Haven, Conn.

[21] Appl. No.: 44,182

[22] Filed: May 31, 1979

[51] Int. Cl.[3] ..... B65H 17/32

[52] U.S. Cl. ..... 226/97; 242/57

[58] Field of Search ..... 226/15, 22, 97, 196; 227/112; 242/57, 57.1; 34/57 R, 57 A

[56] References Cited

U.S. PATENT DOCUMENTS

| | | | |
|---|---|---|---|
| 2,871,013 | 1/1959 | Markey | 226/22 X |
| 3,490,674 | 1/1970 | Ott, Jr. et al. | 226/19 |
| 3,521,802 | 7/1970 | Bossons | 226/97 |
| 3,881,414 | 5/1975 | D'Amato et al. | 226/22 X |

*Primary Examiner*—Leonard D. Christian

*Attorney, Agent, or Firm*—Victor A. DiPalma; Paul Weinstein

[57] ABSTRACT

A method and apparatus are disclosed for automatically centering running lengths of strip material of different widths. The strip material is passed between an elongated air source and an elongated pressure pickup device. Depending on whether and in which way the strip moves laterally off center a conductive diaphragm located within a sensing device is deflected by a differential air pressure causing electric and hydraulic control circuits to adjust a steering roll thereby continuously and automatically centering the strip material.

21 Claims, 11 Drawing Figures

HYDRAULIC AMPLIFIER
CONTROL CIRCUIT
41
95
90
40
88
86
82
85
85
79
83
60
67
63
66
75
68
67
66
64
9
14
14'
8
52
52
12

STRIP MATERIAL CENTER GUIDE ASSEMBLY

BACKGROUND OF THE INVENTION

For years it has been common practice in strip treating plants to attempt to maintain the strip being treated centered on one or more of a series of rolls. To accomplish this end one or more steering rolls were provided in the treatment line to steer the strip material and maintain the centerline thereof as close as possible to a desired point on the rolls, normally the middle of the rolls.

Initially control for such steering rolls were mechanical and were manually operated, such as for example by manually turning a screw operated jack thereby adjusting the steering roll in some fashion.

It has become common practice to operate such steering rolls in an easier manner, such as by hydraulic controls, electric motors, and the like. These controls are most often triggered automatically by strip edge detectors which are located at one or both edges of the moving strip material. Each time a particular width strip is placed on a processing line whatever edge detectors were utilized to signal the control means had to be manually adjusted for the particular width of strip material.

Manual adjustment of edge detectors is quite undesirable. For example, in a typical strip anneal line one might find as many as six or more steering rolls. An operator would have to follow the leading edge of a particular width of strip material and reset each edge detector. When processing shorter strips, by the time such a strip reached the end of the processing line the operator would have to start all over again at the beginning. Should the operator forget to readjust for a different width strip, the edge detectors will continue to sense the edge as if it were the same width strip. In the case of a wider strip following a narrower one, the strip might well hang over an edge of the roll causing severe damage and down time.

It would thus be clearly desirable to economically provide a detector which automatically guides the center of a strip material over a particular point of the steering roll or rolls regardless of the width and length of strip material being processed. If the strip moves laterally during processing it can be brought back automatically on line.

PRIOR ART STATEMENT

It known to utilize edge detectors to determine the position of the edge (s) of strip material relative to a steering roll and in response to such a determination to automatically steer the strip such that the edge (s) are continuously and automatically substantially aligned with the detectors. Such detectors have normally comprised photo-electric scanning means as disclosed in U.S. Pat. No. 2,399,418. Other types of edge detectors, such as for example air-pressure responsive and feeler devices have on occasion been utilized. The problems with such edge detectors is that they must be manually adjusted for different widths of strip material thereby leading to slower runs, increased labor costs, and increased chance for error and thus equipment damage and material loss.

Use of guide devices such as those depicted in U.S. Pat. Nos. 3,119,534 and 3,692,223 find utility when moving strips of material must be precisely positioned for performing very precise forming or machining operations, but have found very little utility in fast run processes such as annealling, cleaning, slitting, rolling and the like where such precision is not required.

It is also known to utilize a light source and light source pickup to simultaneously span at least two edge portions of a strip material to provide a signal which will operate steering roll adjusting means to automatically center varying width strips on the steering roll. Such a system is extremely expensive, requiring expensive photo-electric parts and controls. Moreover, such a light source is prone to difficulty of operation when it gets dirty or when light sources wear out and/or begin to fail in that false signals can result.

It is highly desirable to provide an inexpensive automatic strip center guide assembly which can effectively and efficiently monitor the location of running strip material with respect to a steering roll, while continuously providing automatic adjustment of the strip along the roll regardless of the width of the strip material.

All prior art patents disclosed and discussed herein are hereby incorporated by reference.

SUMMARY OF THE INVENTION

In accordance with this invention, an improved strip center guide assembly is disclosed which is readily adaptable to be used in conjunction with conventional steering rolls utilized in strip treating lines. The center guide assembly provides automatic adjustment of running strip material along a steering roll surface, without the necessity of presetting the apparatus for strips of differing widths.

It has been found in accordance with this invention that an economical and efficient center guide apparatus can be provided by directing a regulated air supply fed through a perforated pipe across the face of a running strip passing between the perforated pipe and a matching split pair of perforated pipes used as air pressure pickups. The differential in pressure felt at these pickups displaces a conductive diaphragm located inside a sensing device causing an electric signal to be sent to the proper solenoid relay so as to activate an adjusting system or steering system to bring the strip back to the center of the pressure source (normally the center of the steering roll).

The center guide assembly of this invention possesses certain advantages over conventional guide systems in that it is readily adaptable to quick manual and automatic controls, it is automatic and need not be adjusted for varying width strips, it is not subject to severe problems when operated in a dirty environment, and it is economical to build, maintain, and place into operation.

Accordingly, it is principal object of the present invention to provide an economical and efficient automatic strip center guide assembly for maintaining strip material at a preselected position along the surface of a roll or rolls.

It is a further object of the present invention to provide a strip center guide system which is particularly suitable for use in a dirty environment.

Other objects and advantages will become apparent to those skilled in the art from a consideration of the description which proceeds with reference to the following drawings.

DETAILED DESCRIPTION OF THE PREFERRED EMBODIMENTS

In accordance with the present invention, the foregoing objects and advantages are readily attained.

The method of this invention comprises passing strip material between an air supply element and an air pressure pickup element, both of which elements span across opposite faces of the strip. When the strip moves laterally is causes a differential in pressure felt by two distinct parts of the air pressure pickup element, which pressure differential is conveyed to a sensing device. The sensing device causes an electrical signal to be sent via a control circuit to an appropriate solenoid relay which activates an adjusting system thereby automatically causing the strip to return to its center position, that is to the longitudinal center of the air supply element.

Figure 1:
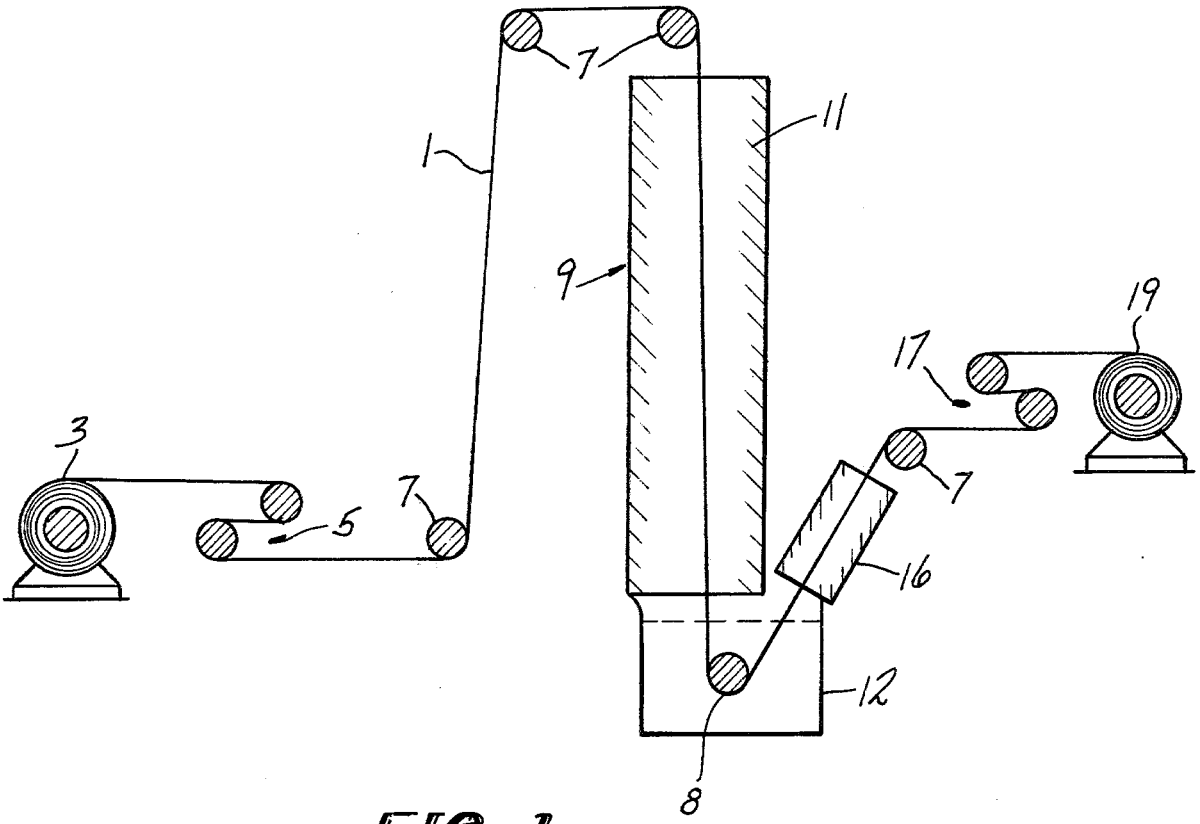
FIG. 1 is a schematic view in side elevation of a typical process line which could employ the strip center guide system of this invention.

A typical process line on which the principals of the present invention might be employed is shown in FIG. 1. A metal strip 1 which is to be treated is unwound from roll 3. The strip is threaded through wrapped roll bridal 5 which controls the entry and line speed of the strip. Various rolls 7, including top entry and exit rolls, are provided as shown to set the path of the strip through the heating zone 11 of a furnance 9. The strip next passes through a quench tank 12 around a steering roll 8 and then through hot air dryer 16. Upon emerging from dryer 16 the strip passes over roll 7 through exit wrap bridal 17 and is recoiled on motorized reel 19.

In the strip treating line of FIG. 1 the strip center guide assembly of this invention could be used to activate adjustment mechanisms attached to any of rolls 3 and 7 or reel 19. However, one embodiment of the strip center guide system of this invention will be shown in conjunction with a furnace 9 and quench tank 12. Details of such a furnace quench tank arrangement can be found in copending application, Ser. No. 44,181 filed on even date herewith.

Figure 2:
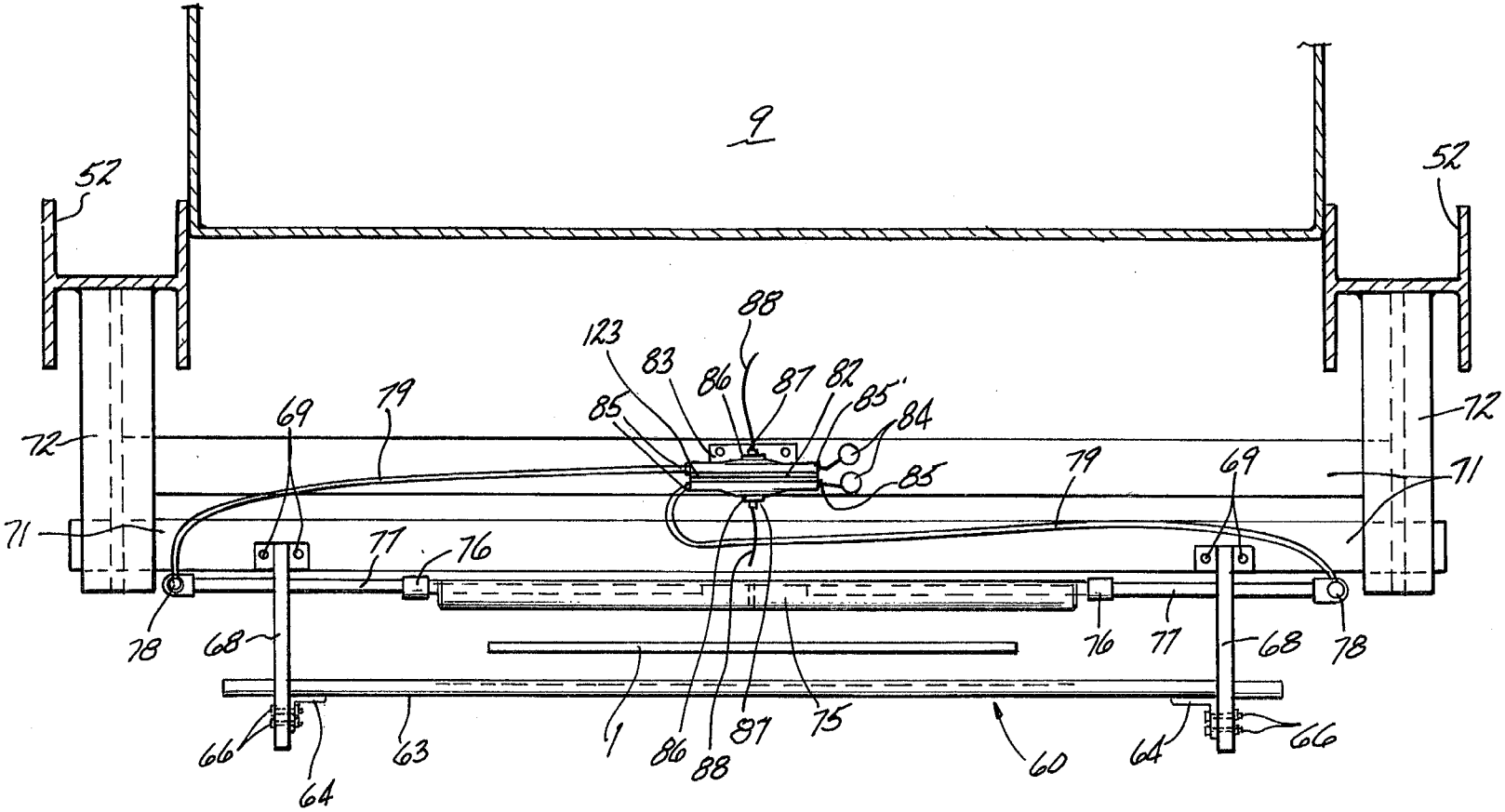
FIG. 2 is a top view of a strip center guide system in accordance with this invention mounted to the support structure of an annealing furnace.
Figure 3:
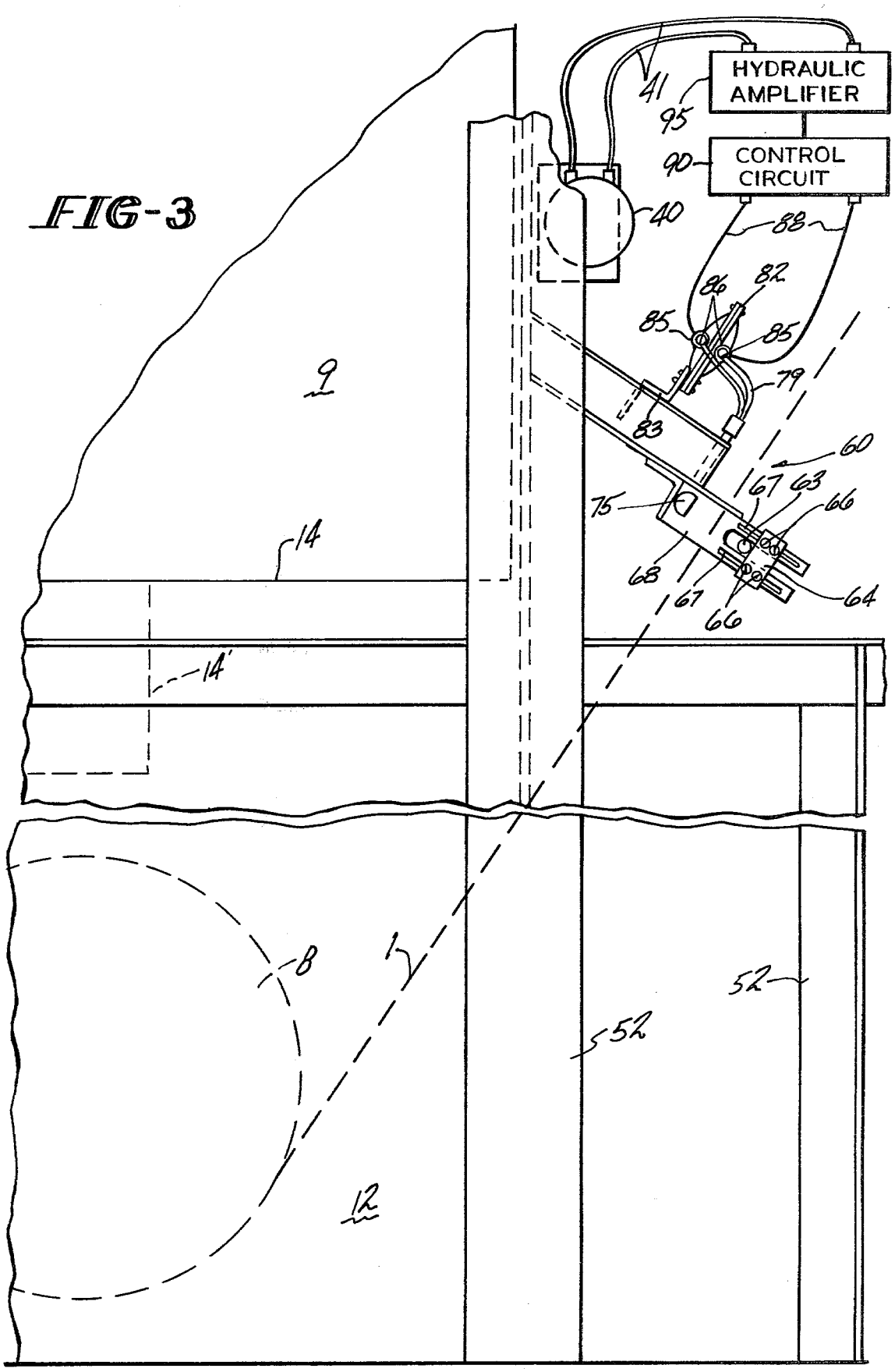
FIG. 3 is a front view of the strip center guide system of FIG. 2, showing a steering roll located within a quench tank beneath the annealing furnace.

FIGS. 2 and 3 illustrate a strip center guide assembly in accordance with this invention associated with a continuous strip furnace-quench tank arrangement. Furnace 9 is supported by I-beam supports 52. Extending from I-beam supports 52 are structural supports 72 to which are secured cross structural supports 71.

Referring now to FIG. 2, a center guide assembly 60 is shown comprising three primary elements as follows: an air supply element 63, an air pressure pickup element 75, and a sensing device 82. Air supply element 63 is slidably mounted via angle iron supports 64 to unistrut frames 68. Unistrut frames 68 are provided with elongated slots 67 (FIG. 3) for receiving bolts 66 which pass through angle iron supports 64 and thus secure air supply elememt 63. Loosening of bolts 66 permits for adjustment of the distance between air supply element 63 and metal strip 1. The distance between air supply element 63 and air pressure pickup element 75 can also be adjusted in this way. Unistrut frames 68 are shown secured to structural support 71 by bolts 69, but any other suitable means for securing may be used, as for example welding or the like.

Figure 9:
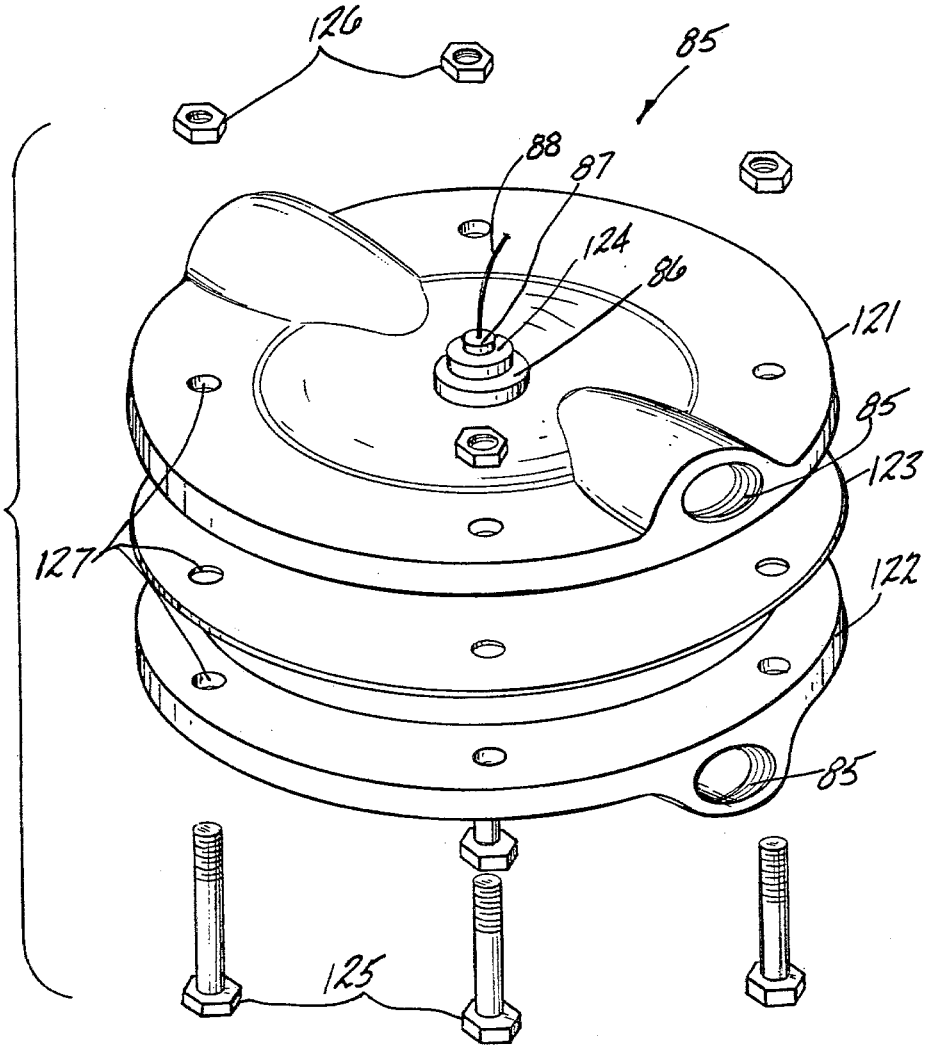
FIG. 9 is an exploded perspective view of a sensing device utilized in a strip center guide assembly in accordance with this invention.

Again referring to FIG. 2 air pressure pickup element 75 is secured via sleeves 76 to conduits 77. Conduits 77 are connected to flexible conduits 79 and are provided with elbows 78 to assist in ease of connection of the lines 79. Lines 79 are connected to a first set of peripheral ports 85 in sensing device 82, each of said first set of peripheral ports 85 being located on opposite sides of a diaphragm 123. Pressure indicators or meters 84 are located in a second set of peripheral ports 85' and provide a ready measurement of the pressure on either side of diaphragm 123. Bracket 83 secures sensing device 82 to structural support 71. Sensing device 82 is also provided with a third set of ports 86, one on each side of diaphragm 123, whose axes are transverse to the plane of diaphragm 123. Secured within ports 86 are bushings 124 (FIG. 9). Adjustable contacts 87 are screw threaded into bushings 124.

FIG. 3 shows a metal strip 1 which after passing through furnace 9 passes through a throat 14' which projects into quench tank 12 and is attached to furnace floor 14. Strip 1 then passes around steering roll 8 and between air supply element 63 and air pressure pickup element 75 prior to passing through dryer 16 (FIG. 1). Center guide system 60 is shown mounted to I-beam supports 52 of the furnacequench tank structures to monitor the position of strip 1 or steering roll 8. Pressure differentials picked up by air pressure pickup element 75 are conveyed to sensing device 82 via flexible conduits 79 which converts such differentials into electrical signals transmitted via wires 88. The signals are directed to a control circuit 90 which activates a hydraulic amplifier 95. Hydraulic amplifier 95, in response to such activation provides a surge of fluid through fluid lines 41 to activate hydraulic cylinder 40 causing steering roll 8 to readjust and maintain strip 1 in the desired position. Such a hydraulic cylinder-steering roll arrangement is depicted in the aforementioned copending application Ser. No. 44,181, and does not constitute a critical aspect of the present invention. In like manner various control circuits and hydraulic amplifiers are well known and do not constitute a critical aspect of the center guide assembly 60 of the instant invention.

Figure 4:
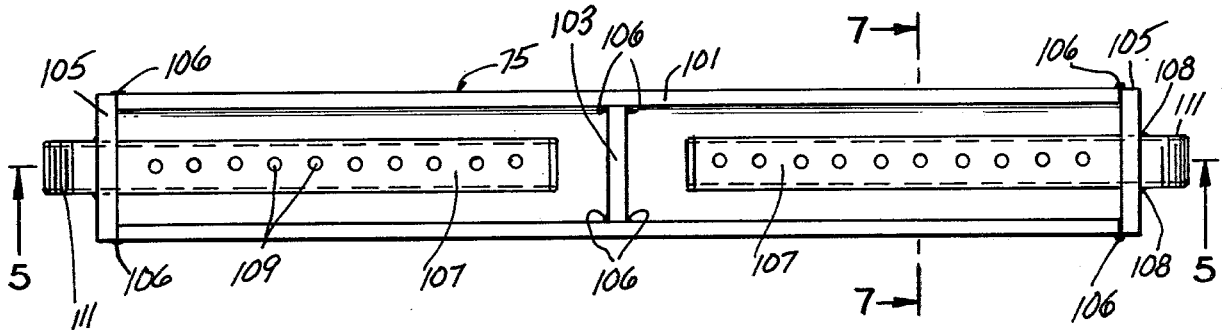
FIG. 4 is a top view of an air pressure pickup element utilized in a strip center guide assembly in accordance with this invention.
Figure 5:
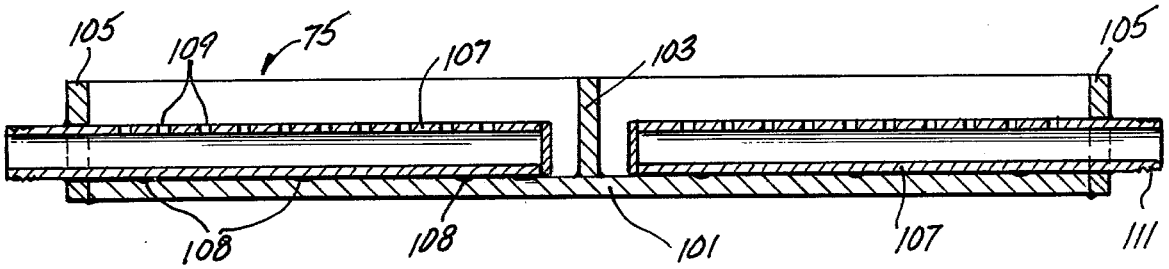
FIG. 5 is a cross-section taken through the line 5—5 in FIG. 4.
Figure 7:
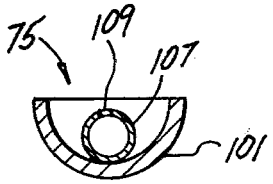
FIG. 7 is a cross-section taken through the line 7—7in FIG. 4.

One embodiment of an air pressure pickup element 75 in accordance with this invention is shown in greater detail in FIGS. 4, 5 and 7. Pickup element 75 comprises an elongated air collector 101 of semi-circular cross-section. Intermediate wall 103 and end caps 105 are secured to air collector 101 by means of welds 106 or by any other suitable means. Pressure pickup conduits 107 pass through end caps 105 and are welded at points 108 to secure the conduits 107 to air collector 101. Pickup conduits 107 are provided with orifices 109 which are aligned in a row parallel to the axis of the conduits 107 and are further provided with threaded ends 111 for attachment to conduits 77 (FIG. 2).

Figure 6:
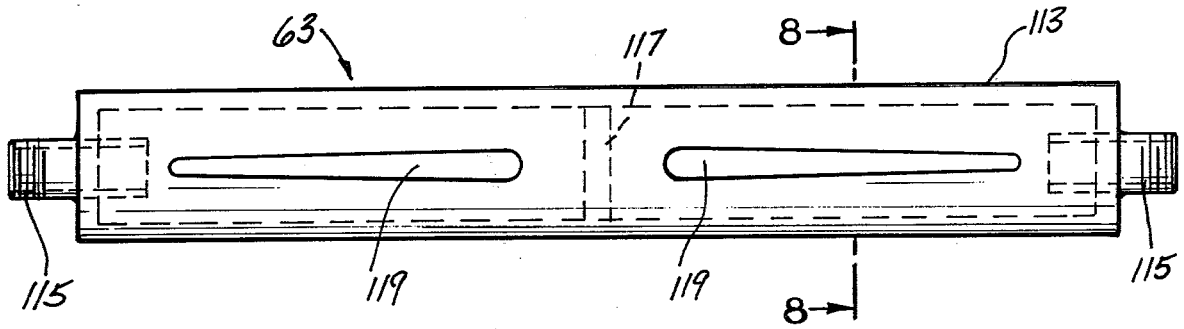
FIG. 6 is a top view of an air supply element utilized in a strip center guide assembly in accordance with this invention.
Figure 8:
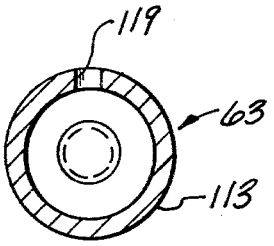
FIG. 8 is a cross-section taken through the line 8—8 in FIG. 6.

Referring now to FIGS. 6 and 8 there is depicted therein a preferred embodiment of air supply element 63. Air supply element 63 consists of a conduit 113 having an intermediate wall 117 and slits 119. Slits 119 are parallel to the axis of conduit 113. Threaded ports 115 are provided at each end of conduit 113 to provide for ready attachment of air supply element 63 to sources of air. During operation both ports 115 receive a substantially equal amount of air.

Orifices 109 of air pressure pickup element 75 preferably have a width approximately equal to those portions of slits 119 opposite therefrom. In addition, orifices 109 could vary in width. The important factor to control is that both the slits 119 and orifices 109 be symmetrical in both directions from walls 117 and 103, respectively.

It is also preferred to provide a taper to slits 119 since the further from ports 115 one goes the less fluid flow which will eminate from supply element 63. Typical dimensions of slits 119 might be approximately 3/16" at the broad end thereof tapering down to approximately ⅛" at the narrow end, each slit running approximately 15". It would of course be possible to use a uniform width slit, and dimensions of approximately ⅛" have been found acceptable.

FIG. 9 shows a sensing device 82 in accordance with this invention to be made up of two facing shell halves 121 and 122 with a flexible diaphragm 123 interposed therebetween. Shell halves 121 and 122 and diaphragm 123 are provided with holes 127 for passage of securing bolts 125 therethrough. Sensing device 82 is fastened by bolts 125 and nuts 126. Each shell half 121 and 122 is provided with first and second peripheral ports 85 and 85' for attachment to flexible conduits 79 and pressure indicators 84 (FIG. 2). The faces of shell halves 121 and 122 are provided with ports 86 having axes transverse to the plane of diaphragm 123. Two rubber bushings 124 (one shown) are secured within ports 86. Adjustably screwed within bushings 124 are two adjustable contacts 87 for providing electrical signals along wire 88 upon contact with diaphragm 123.

Diaphragm 123 is constructed of a flexible material such as mylar or rubber which is rendered conductive by coating with a conductive paint. Alternatively, diaphragm 123 could be rendered conductive by mounting a conductive strip material thereon. Bushing 124 must act as an insulator and might typically be constructed of rubber or a like material.

Figure 10:
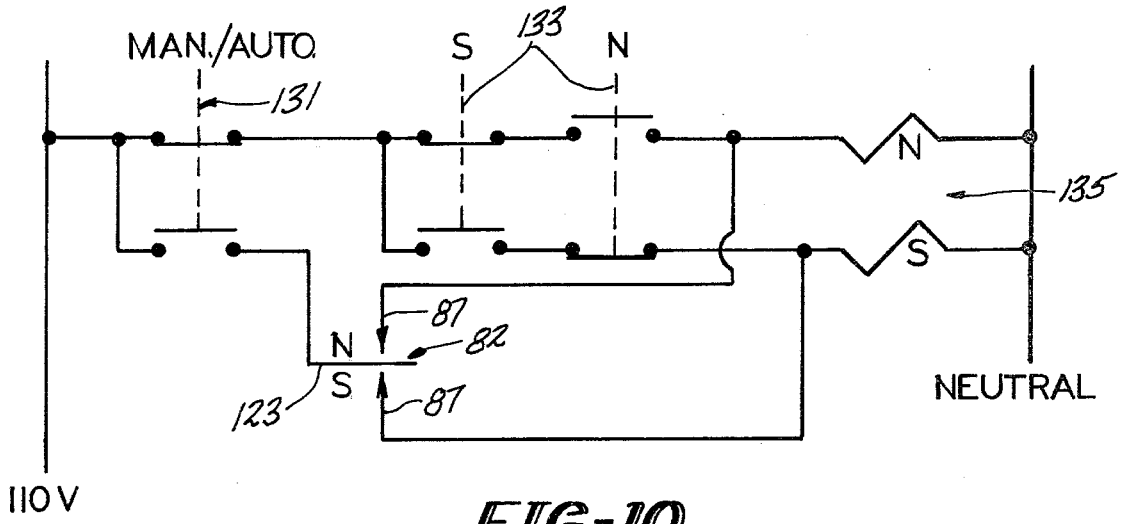
FIG. 10 is a circuit diagram of one embodiment of a control circuit utilized for transmitting an electric signal from the sensing device of FIG. 9 to an appropriate solenoid relay for properly activating a roll steering or adjusting system.
Figure 11:
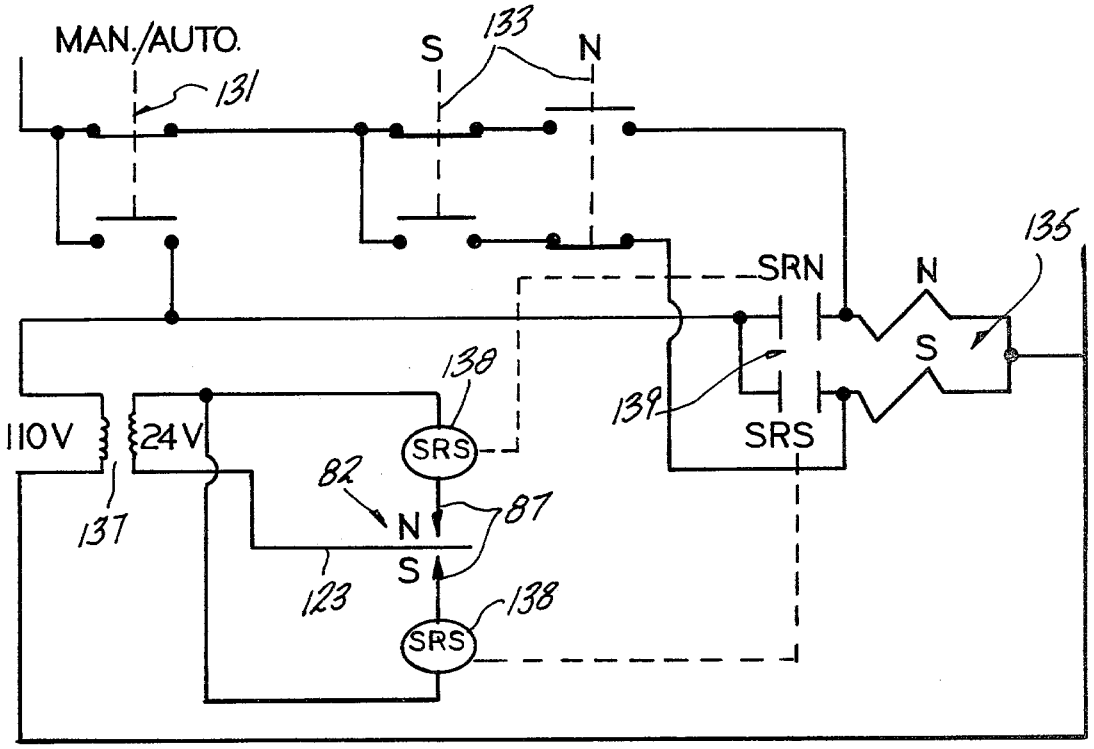
FIG. 11 is a circuit diagram similar to FIG. 10 showing a step-down transformer for providing a lower working voltage to the sensing device of FIG. 9.

FIGS. 10 and 11 represent embodiments of two control circuits which could be used with the center guide assembly of this invention. For purposes of clarity it will be assumed that when hydraulic cylinder 40 and thus steering roll 8 is activated it results, depending on the signal received from the control circuit, in a lateral movement of strip 1 in either a north (N) or south (S) direction across steering roll 8.

The circuit of FIG. 10 shows a 110 volt source attached to a manual/automatic selector switch 131. Switch 131 is shown in the manual mode and an operator can activate either a north (N) or a south (S) solenoid valve 135 by selecting and throwing manually operated north (N) or south (S) switches 133, as desired. Solenoid valve coils 135 activate hydraulic cylinder 40 via hydraulic amplifier 95 (FIG. 3) in a known manner, to move strip 1 in the selected direction.

Setting manual/automatic selector switch 131 on automatic places steering roll 8 under automatic control of center guide assembly 60 of this invention. The circuit in FIG. 10 is then activated by sensing device 82 when as a result of a pressure differential between pressure pickup conduits 107 diaphragm 123 is flexed toward a north (N) or south (S) adjustable contact 87. Depending on which contact 87 is touched by diaphragm 123 either the N or S solenoid valve coils 135 activate hydraulic cylinder 40, as discussed previously It is desirable to put a lower voltage on the sensing device 82 to get less current flow through diaphragm 123. This helps to prevent arcing problems and more frequent service of diaphragm 123.

FIG. 11 depicts a circuit similar to FIG. 10, with a stepdown transformer 137 being interposed between manual/automatic selector switch 131 and sensing device 82. Contacts 87 of sensing device 82, upon making contact with diaphragm 123, operate coil operated relays 138 which are mechanically connected to contacts 139 thereby activating solenoid valve coils 135. FIG. 11 depicts a 110 Volt-24 volt stepdown transformer and thus relays 138 would be 24 volt relays, SRN designating steering roll north and SRS designating steering roll south.

Calibration of sensing device 82 is accomplished as follows: with the power off and wiring removed from adjustable contacts 87, connect an ohm meter from either shell half 122 to adjustable contact 87 to be adjusted. Shut off air and pickup feed. Adjust contact 87 slowly until continuity is just indicated on meter, then back off until meter just indicates an open circuit. Adjust both contacts 87 in the same manner. When complete and wiring is reconnected, the sensing device 82 will be in its most sensitive state of calibration.

The operation of the center guide assembly 60 of this invention is as follows: air pressure pickup element 75 and air supply element 63 are arranged in spanning relation to the path of travel of strip 1, and the center portion or walls 103 and 117 respectively thereof are arranged over the desired longitudinal center line path of strip 1. Upon running along this center line the strip 1 is considered to be centered. Air from supply element 63 is directed across the surface of moving strip 1, with only that air which passes over the edges of strip 1 effectively reaching pressure pickup element 75. Independent pressure pickup conduits 107 sense the air pressure and as the strip 1 moves off center (assuming a southward shift) a pressure differential develops, that is one pressure pickup conduit 107 experiences a greater air pressure than the other pressure pickup conduit 107. This pressure differential is conveyed to sensing device 82 via conduits 79 causing diaphragm 123 to deflect toward the low pressure side of sensing device 82 till it finally makes contact with an adjustable contact 87 (depicted N in FIG. 10). This contact causes activation of solenoid valve coil N which then acticates hydraulic cylinder 40 via hydraulic amplifier 95 (FIG. 3) to engage steering roll 8 and move the strip in the north direction, or back toward center. The operation of center guide assembly 60 is thus continuous and automatic, regardless of the width of strip 1. The only limitation on strip width is that the edges of the centered strip fall somewhere within the air pressure range established by slits 119 and orifices 109.

While the center guide assembly of this invention has been described in conjunction with a furnace-quench tank and with a hydraulically activated steering roll it is to be understood that the mechanism will operate to signal any type of steering mechanism, as for example jacking systems, sliding base, and motor operated mechanisms, and may be used in conjunction with any type of strip processing line, as for example, slitting, rolling, cleaning and the like lines.

The center guide assembly of this invention does provide several particular benefits. It is a completely automatic and continuous strip centering guide assembly which once installed requires no manual intervention regardless of strip width; it is considerably easier and cheaper to construct than photo-electric devices by several orders of magnitude; it is not prone to giving off a false signal upon getting dirty as is the case with photo-electric devices and generally requires less maintenance than such devices; and it can be readily and easily be adjusted to provide for greater sensitivity to lateral strip movement. In addition, in the embodiment described, the air flow of the center guide assembly of this invention provides at least a partial drying function to the wet strip material as it passes through the device.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A center guide assembly comprising means for automatically maintaining without mechanical adjustment a desired centerline path of travel for moving individual strip material segments which can have widely different widths, said automatic maintaining means including:

means in substantial spanning relation to said path of travel on one side of and extending beyond both edges of said strip for continuously supplying a flow of air across said path of travel of said material;

means in substantial spanning relation to said path of travel on the other side of said strip for collecting two separate portions of said flow of air, said separate portions each passing and being associated with one of said edges; and means connected to said collecting means for sensing any pressure differential between said separate portions of said flow or air and for providing a signal in response to said pressure differential, whereby individual running lengths of strip material having widely different widths can be automatically centered.

2. A center guide assembly according to claim 1 wherein said means for continuously supplying a flow of air comprises an air supply element, said air supply element including a conduit having an intermediate wall therein and at least two slits in the outer surface thereof, at least one of said slits being located on each side of said wall, said slits being aligned and parallel to the axis of said conduit, and said slits being of equal dimension at equal distances from said wall.

3. A center guide assembly according to claim 2 wherein said conduit is provided with ports at each end thereof for attachment to two air sources.

4. A center guide assembly according to claim 3 wherein said slits are tapered such that the ends of said slits closest to said wall are wider than the ends of said slits closest to said ports.

5. A center guide assembly according to claim 1 wherein said means for collecting said separate portions of said flow of air comprises an air pressure pickup element, said pickup element including at least two orifices in the outer surface thereof, said orifices being aligned and parallel to the axis of said pressure pickup conduits.

6. A center guide assembly according to claim 5 wherein said means for collecting said separate portions of said flow of air includes an elongated scoop shaped air collector having an intermediate wall perpendicular to the axis thereof, said conduits being located on opposite sides of said wall within said scoop shaped air collector, said orifices being parallel to and substantially opposite from the closed end of said scoop shaped air collector.

7. A center guide assembly according to claim 6 wherein said conduits have one closed end and one open end, said open end having means for connection to said means for sensing any pressure differential between said separate portions of said flow of air.

8. A center guide assembly according to claim 1 wherein said means for sensing any pressure differentials between said separate portions of said flow of air and for providing a signal comprises a sensing device, said sensing device including a conductive diaphragm mounted between two shell halves.

9. A center guide assembly according to claim 8 wherein said means for collecting said separate portions of said flow of air comprises an air pressure pickup element, said pickup element including at least two pressure pickup conduits having means for connection to said sensing device.

10. A center guide assembly according to claim 9 wherein said shell halves each include at least one peripheral port for connection to one of said pressure pickup conduits.

11. A center guide assembly according to claim 10 wherein said shell halves each include a face port, said face port having an axis transverse to the plane of said diaphragm.

12. A center guide assembly according to claim 11 including an insulator bushing located within said face port, said insulator bushing having an adjustable contact mounted therein.

13. A center guide assembly according to claim 12 wherein said adjustable contact is screw threaded.

14. A center guide assembly according to claim 11 wherein said shell halves each include a second peripheral port, said second peripheral port having a pressure indicator secured therein.

15. A center guide assembly according to claim 12 including two solenoid valve coils, each of said coils being electrically connectable to said adjustable contacts upon deflection of said diaphragm.

16. A center guide assembly according to claim 8 wherein said conductive diaphragm is constructed of a material selected from the group consisting of rubber or mylar, said material having a conductive coating thereon.

17. A center guide assembly according to claim 16 wherein said conductive coating is painted on said diaphragm.

18. A center guide assembly according to claim 16 wherein said conductive coating is a conductive strip adhesively secured to said diaphragm.

19. A process for continuously monitoring the path of travel of running strip material and for automatically providing an appropriate signal to an adjusting mechanism to bring said strip material back to a desired path of travel when it moves laterally therefrom, comprising:

placing an air pressure pickup element having at least two distinct pressure pickup conduits and an air supply element in spanning relation to said path of travel and the faces of said strip material, said elements being located in opposed relationship on opposite sides of said strip material;

directing air flow from said supply element across the surface and past both edges of said strip material, said air flow past said edges defining first and second portions of said air flow;

substantially collecting said first and second portions of said air flow by said at least two distinct pressure pickup conduits in the form of first and second air pressures, respectively;

sensing any pressure differential between said first and second air pressures, said differential being a result of lateral movement of said strip off said desired path of travel; and sending an adjustment signal to said adjusting mechanism to automatically return said strip back to said desired path of travel.

20. A process according to claim 19 wherein said step of sensing comprises providing a sensing device formed by two shell halves having an interposed flexible conductive diaphragm in spanning engagement therewith, said shell halves having contact elements extending to a point adjacent said diaphragm, and conveying said first and second air pressures to opposite sides of said diaphragm such that the air pressure differential caused by said lateral movement causes said diaphragm to flex and make contact with said contact elements sending a corrective signal to said adjusting mechanism, whereby said strip is automatically returned to said desired path of travel.

21. A process according to claim 19 wherein said step of directing air flow includes the step of supplying approximately equal amounts of air to opposite ends of said air supply element.

* * * * *